United States Patent [19]

Stumpf et al.

[11] Patent Number: 4,485,506

[45] Date of Patent: Dec. 4, 1984

[54] COIL SPRING CONSTRUCTION

[75] Inventors: Walter Stumpf; Paul J. Dillion, both of Dunwoody, Ga.

[73] Assignee: Simmons U.S.A. Corporation, Atlanta, Ga.

[21] Appl. No.: 482,759

[22] Filed: Apr. 7, 1983

[51] Int. Cl.[3] ..... A47C 27/05; A47C 27/07; F16F 3/10

[52] U.S. Cl. ..... 5/477; 5/478; 267/83

[58] Field of Search ..... 5/477, 480, 481, 478; 267/83, 84

[56] References Cited

U.S. PATENT DOCUMENTS

| | | | |
|---|---|---|---|
| 1,253,272 | 1/1918 | Nachman | 5/477 |
| 1,406,051 | 2/1922 | Marcus et al. | 5/477 |
| 2,461,062 | 2/1949 | Kane | 5/477 |
| 3,099,021 | 7/1963 | Wetzler | 5/477 |
| 3,401,411 | 9/1968 | Morrison | 5/481 |
| 3,462,779 | 8/1969 | Thompson | 5/477 |
| 4,234,983 | 11/1980 | Stumpf | 5/477 |
| 4,429,427 | 2/1984 | Sklar | 5/477 |

FOREIGN PATENT DOCUMENTS

| | | | |
|---|---|---|---|
| 449795 | 7/1936 | United Kingdom | 5/477 |

*Primary Examiner*—Alexander Grosz
*Assistant Examiner*—Vinh T. Luong

[57] ABSTRACT

A coil spring construction is provided for incorporation within a mattress or cushion. The construction includes a plurality of independently mounted pocketed coil springs. Resilient stabilizers are provided between the springs to maintain their axial positions. The spring pockets are formed by the sealing of first and second sheets to each other in a substantially circular configuration about the axis of each spring. Spring height is determined by the inside diameter of the seal.

8 Claims, 6 Drawing Figures

COIL SPRING CONSTRUCTION

BACKGROUND OF THE INVENTION

1. Field of the Invention

The field of the invention relates to a coil spring construction for a mattress or cushion or the like.

2. Brief Description of the Prior Art

A number of different coil constructions are known to the art, many of which employ a combination of coil springs and foam. U.S. Pat. No. 4,234,984 discloses a non-nested arrangement of pocketed coil springs made from strips of thermally welded construction. Such strips are described in U.S. Pat. No. 4,234,983.

Coil spring/foam constructions are disclosed in U.S. Pat. Nos. 3,099,021, 3,462,779, and 3,869,739. U.S. Pat. No. 1,253,272 provides a cotton felting between strips of pocketed springs. U.S. Pat. No. 1,406,051 discloses a spring pad made from a pair of fabrics stitched together so as to provide spring pockets therein.

SUMMARY OF THE INVENTION

A spring construction is provided which includes a plurality of independent pocketed coil springs. Each coil spring is separated from adjacent springs by a resilient material to eliminate potential hang-up or interference therewith. The pockets are defined by top and bottom fabric layers which may be stitched or welded in a substantially arcuate configuration about the axis of each coil. The diameter of the stitch or weld pattern determines the height of the uncompressed spring.

By forming the pockets in the above-described manner about the axis of each coil spring and at substantially the middle portions thereof, a fabric flange is defined about each coil spring. The flange portions are substantially perpendicular to the spring axes.

The resilient material is positioned above and below the middle flange portions to lend stability to the construction. Due to their independent arrangement, the coils would otherwise tend to lean with respect to the plane defined by the flange portions. The resilient material may be a foam layer having a plurality of holes cut therein for accomodating each spring. Both layers are substantially parallel to the flange portions.

A number of advantages are provided by the present spring construction. The free coil movement not only eliminates interference of adjacent coils, but also insures that an individual coil will not remain in a compressed condition creating a hole or pocket with respect to surrounding coils. More judicious use of wire and pocketing material is also possible thereby reducing the cost of mattress or cushion construction. A greater variation in firmness and comfort characteristics may be achieved by employing various coil spring stabilizers such as foams of different density. Any coil shape, e.g. hour glass, barrel, and cylinder, may also be utilized.

DETAILED DESCRIPTION OF THE INVENTION

A mattress 10 including an arrangement of pocketed coil springs 12 and foam layers 14, 16, 18, 20 is provided by the invention. The coil springs are arranged in rows while the foam layers are substantially parallel to each other.

Figure 2:
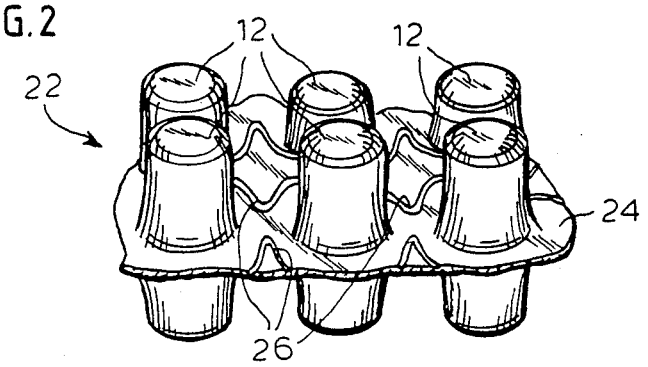
FIG. 2 is a perspective view of a spring assembly according to the invention.
Figure 1:
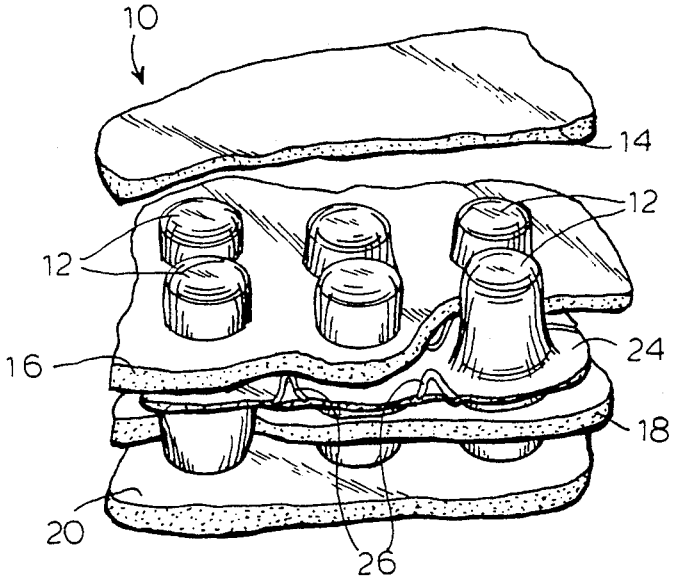
FIG. 1 is a partially cutaway and partially exploded perspective view of a mattress portion including a spring assembly according to the present invention.

A coil spring assembly 22 in accordance with the invention is shown in FIG. 2. It includes a plurality of rows of parallel pocketed coil springs 12, each of which is independently mounted so as to avoid potential hang-up with adjacent springs. The springs are separated by a planar fabric layer 24 perpendicular to the respective axes thereof and comprising a pair of fabric sheets as described hereinafter. Pockets are formed in these layers by a plurality of arcuate lines 26 interconnecting them. The lines 26 are formed about the axis of each spring by means of stitching or thermal welding. A substantially circular pattern about each spring is preferred to facilitate centering within the pockets.

Figure 4:
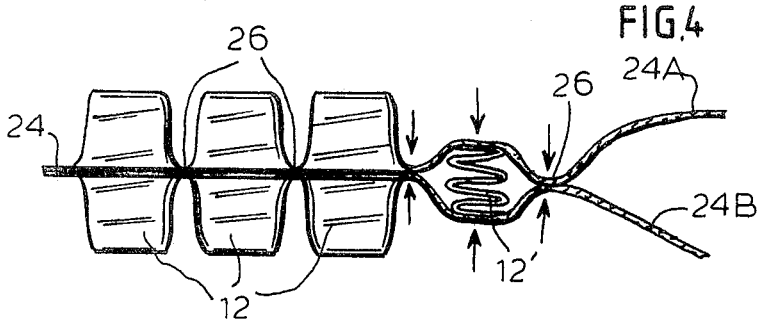
FIG. 4 is a side elevation view of a first step for manufacturing the spring assembly of FIG. 2.
Figure 5:
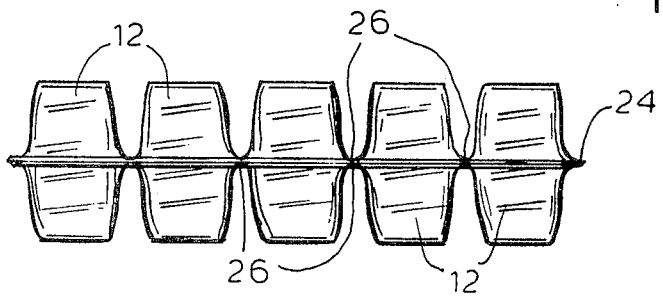
FIG. 5 is a side elevation view illustrating the manufacturing step following FIG. 4.
Figure 6:
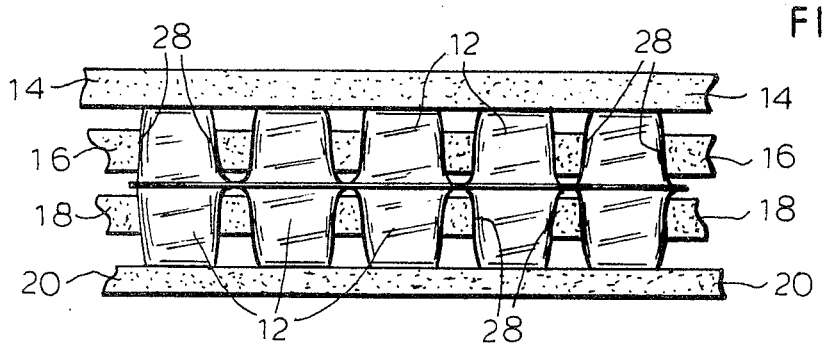
FIG. 6 is a sectional side elevation view illustrating the spring assembly following the mounting of resilient spring separators.
Figure 3:
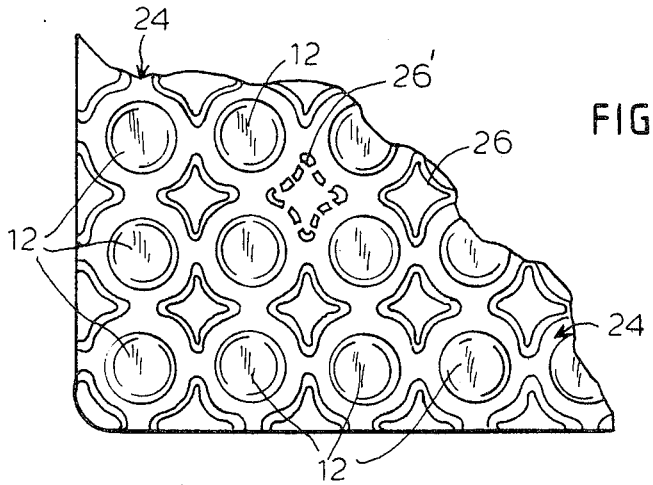
FIG. 3 is a top view of a spring assembly according to the invention.

A method for constructing a spring assembly according to the invention is illustrated in FIGS. 4–6. Springs 12' are arranged in a feeding machine positioned to insert compressed springs between a first fabric sheet 24A and a second fabric sheet 24B. The springs are sequentially compressed and inserted while the sheets are stitched or welded together. As discussed above, the interconnecting lines 26 defining each spring pocket are formed in circular patterns about the axes of the respective springs. The sheets are preferably made from thermally weldable material and are ultrasonically sealed in a pattern of discrete welds, each having four arcuate sides as shown in FIG. 3. The sealing lines may be solid or dashed as designated by numerals 26 and 26', respectively. The inside diameter of the sealing pattern controls the height of the finished pocketed coil. It has been found that a seal diameter of seven inches gives a six inch pocketed coil height. Similarly, a six inch seal diameter results in a five inch height. As shown in FIG. 3, a clearance is provided between the outside diameter of the coil and the inside diameter of the sealing pattern. A structure as shown in FIG. 2 or 5 is accordingly provided. One advantage of this method is that the springs may simply be allowed to expand after insertion and to not require turning. As shown in FIG. 4, the compressed string 12' inserted between the fabric sheets 24A and 24B will simply expand after sealing to form a pocketed coil having the same height as the previously formed pocketed coils. In methods where compressed springs are inserted into folded strips which are then stitched or welded in a rectangular pattern, the springs must be turned after insertion so that their axes are substantially colinear with the longitudinal axes of the resulting pockets.

Once a sufficient number of coils have been assembled into rows, a pair of integral resilient stabilizers 16,18 made from polyurethane foam or any other suitable material are mounted, respectively, to the tops and bottoms of the pocketed spring assembly. Each stabilizer is provided with a plurality of holes 28 corresponding to the arrangement of pocketed coil springs. The springs fit within the holes as shown in FIG. 6 and are stabilized against movement in any direction. The spring axes are accordingly maintained perpendicularly with respect to the planar fabric layer 24. It will be appreciated that the pocket material is held taut upon expansion of the springs.

A second pair of resilient layers 14,20 are applied above and below the spring assembly prior to mounting within a cushion or mattress. These do not have holes and instead rest upon the respective tops and bottoms of the pocketed springs. By selecting various coil stabilizers such as foams of different resiliency, the firmness and comfort characteristics of the final product can be controlled.

While barrel-shaped coils are shown herein, it is clear that hour glass or cylindrical coils may alternatively be employed. It is apparent that fewer coils may be employed in comparison to state-of-the-art constructions. In addition, the number of coils in any particular area of a mattress may be adjusted as desired. The fabric layer 24 preferably defines a plane intersecting the midpoints of the axes of the pocketed coil springs 12. However, it may alternatively be positioned above or below this level and the stabilizers constructed accordingly.

What is claimed is:

1. A coil spring construction comprising:

a fabric layer defined by interconnected top and bottom sheets and defining a plane;

a plurality of spring pockets defined by said top and bottom sheets and extending substantially perpendicularly from said plane;

at least one spring positioned within each of said spring pockets and maintaining said spring pockets taut;

said spring pockets being separated from each other by planar portions of said fabric layer thereby allowing said springs to act independently from one another during compression or expansion; and stabilizing means including a resilient layer having a plurality of holes therein, said spring pockets each extending at least partially within one of said holes and being maintained in said substantially perpendicular positions with respect to said plane;

said spring pockets extending both above and below said plane, said stabilizing means including first and second resilient layers each having a plurality of holes therein, said holes in said first resilient layer receiving portions of said spring pockets extending from one side of said plane and said holes in said second resilient layer receiving portions of said spring pockets extending from the other side of said plane.

2. A coil spring construction as defined in claim 1 wherein said top and bottom sheets are connected by substantially circular lines of connection extending about the axis of each spring.

3. A coil spring construction as defined in claim 2 wherein said top and bottom sheets are thermally welded by said substantially circular lines.

4. A coil spring construction as defined in claim 1 wherein said plane substantially intersects the midpoints of the axes of said springs.

5. A coil spring construction as defined in claim 1 including a third resilient layer positioned upon the ends of said spring pockets on one side of said plane, said first, second, and third resilient layers being substantially parallel to each other.

6. A coil spring construction as defined in claim 5 including a fourth resilient layer positioned upon the ends of said spring pockets on the other side of said plane, said fourth resilient layer being substantially parallel to said first, second, and third resilient layers.

7. A coil spring construction as defined in claim 6 wherein each of said resilient layers is of polyurethane foam.

8. A coil spring construction as defined in claim 1 including a plurality of rows of spring pockets and a plurality of rows of discrete welds, each weld including four arcuate sides, extending between said rows of spring pockets.

* * * * *

UNITED STATES PATENT AND TRADEMARK OFFICE

CERTIFICATE OF CORRECTION

PATENT NO. : 4,485,506

DATED : December 4, 1984

INVENTOR(S) : Walter Stumpf and Paul J. Dillon

It is certified that error appears in the above-identified patent and that said Letters Patent is hereby corrected as shown below:

On the cover page of above-identified patent, after "[75] Inventors:", change "Paul J. Dillion" to read -- Paul J. Dillon --.

Signed and Sealed this

*Ninth* Day of *April 1985*

[SEAL]

*Attest:*

DONALD J. QUIGG

*Attesting Officer*

*Acting Commissioner of Patents and Trademarks*